United States Patent [19]

Beyens et al.

[11] 4,228,927

[45] Oct. 21, 1980

[54] LIQUID DISPENSING HEAD AND INSTALLATION

[75] Inventors: Jozef Beyens; Guillaume Dewit; Jules Lambrechts, all of Ruisbroek aan de Rupel, Belgium

[73] Assignee: Konstruktie J. Lambrechts p.v.b.a., Ruisbroek aan de Rupel, Belgium

[21] Appl. No.: 956,357

[22] Filed: Oct. 30, 1978

[30] Foreign Application Priority Data

Mar. 7, 1978 [GB] United Kingdom ..... 09018/78

[51] Int. Cl.[3] ..... B67D 1/04

[52] U.S. Cl. ..... 222/148; 134/166 C; 222/400.7

[58] Field of Search ..... 222/148, 400.7, 400.8, 222/504; 141/90, 91; 137/212, 240; 134/102, 166 C, 169 C; 239/112, 113

[56] References Cited

U.S. PATENT DOCUMENTS 2,619,119 11/1952 Warcup ..... 137/240 X

FOREIGN PATENT DOCUMENTS 2318165 10/1974 Fed. Rep. of Germany ..... 222/148

2623039 12/1977 Fed. Rep. of Germany ..... 222/148

7610470 3/1977 Netherlands ..... 222/148

*Primary Examiner*—F. J. Bartuska

*Attorney, Agent, or Firm*—Salter & Michaelson

[57] ABSTRACT

A dispensing head of the kind adapted to be bitted to a container, such as a beer keg, having a plunger with which the dispensing head co-operates to enable liquid in the container to be dispensed through the outlet of the dispensing head under pressure of carbon dioxide gas supplied to the container through the dispensing head. The dispensing head is provided with an inlet for connection to a source of rinsing water and a valve mechanism which can be operated to cut off the flow of liquid from the container through the outlet and to connect the water inlet to the outlet so that rinsing water flows through the outlet and through any pipe and dispensing tape connected to the outlet, which can thus be rinsed without removing the dispensing head from the container. The valve mechanism can be remotely operated, using the pressure of the rinsing water to operate the valve mechanism, the water acting on a piston fixed to a movable valve member of the valve mechanism.

11 Claims, 6 Drawing Figures

LIQUID DISPENSING HEAD AND INSTALLATION

Figure 1:
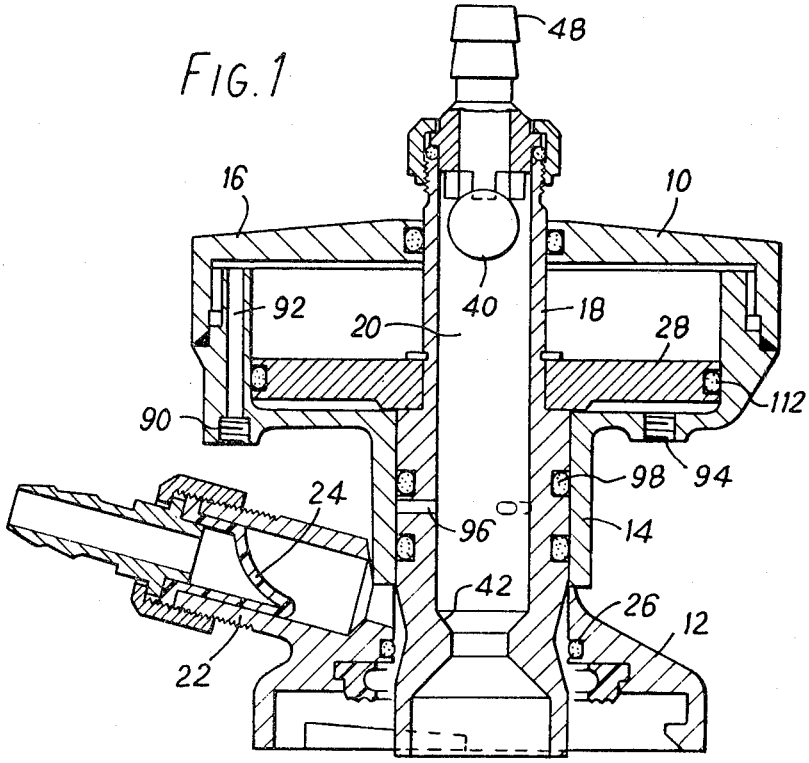

This invention relates to dispensing heads.

More particularly, the invention relates to dispensing heads of the kind adapted to be fitted to a container having a valve plunger with which the dispensing head co-operates to enable liquid in the container to be dispensed through the dispensing head under pressure of a gas supplied to the container through the dispensing head, the dispensing head having inlet means for connection to a source of the pressurising gas and outlet means for connection to a dispensing tap. Such a dispensing head is hereinafter referred to as a dispensing head of the kind set forth.

The invention is particularly, though not exclusively, applicable to dispensing heads for use with kegs from which beer or lager is dispensed under pressure of carbon dioxide supplied through the dispensing head, the dispensing head being connected to a pipe which feeds the beer to a dispensing tap. Such installations are widely used, for example in public houses and restaurants.

In a patent application of Jozef Beyens filed on Oct. 30, 1978, Ser. No. 956,358 and assigned to the same assignee, there is described a dispensing head of the kind set forth, in which the dispensing head has further inlet means adapted to be connected to a source of rinsing fluid and valve means movable between a first position in which the further inlet means is closed, the first inlet means is in communication with the interior of the container to which the dispensing head is fitted and the outlet means is in communication with the interior of the container through the valve plunger so that liquid is dispensed from the container, and a second position in which the first inlet means is closed and the outlet means is disconnected from the interior of the container and placed in communication with the further inlet means so that rinsing fluid flows through the outlet means.

In a preferred form of the dispensing head described in the aforesaid application, the valve means comprises a valve member vertically movable in a body of the dispensing head between a first position in which, in use, the valve member engages the valve plunger and holds it in its open position and a second position in which the valve member is disengaged from the valve plunger, and the valve member includes a piston movable in a cylinder forming part of the body of the dispensing head, an inlet to the cylinder being connected in use to the source of pressurising gas so that the pressure of the gas urges the valve member to its first position.

It has now been realised that further advantages can be obtained by using the rinsing water instead of pressurized gas to urge the valve member to its first position.

Accordingly, this invention includes a dispensing head of the kind set forth, in which the dispensing head has further inlet means adapted to be connected to a source of rinsing fluid and valve means movable between a first position in which the further inlet means is closed, the first inlet means is in communication with the interior of the container to which the dispensing head is fitted and the outlet means is in communication with the interior of the container through the valve plunger so that liquid is dispensed from the container, and a second position in which the first inlet means is closed and the outlet means is disconnected from the interior of the container and placed in communication with the further inlet means so that rinsing fluid flows through the outlet means, the valve means comprising a valve member vertically movable in a body of the dispensing head between a first position in which, in use, the valve member engages the valve plunger and holds it in its open position and a second position in which the valve member is disengaged from the valve plunger, and in which the valve member includes a piston movable in a cylinder forming part of the body of the dispensing head, and an inlet to the cylinder is adapted to be connected to the source of rinsing fluid so that the pressure of the rinsing fluid, in use, urges the valve member to its first position.

Preferably, the further inlet means is in communication with the cylinder so that when rinsing water is supplied to the further inlet means whilst supply of rinsing water to the inlet in the cylinder is cut off, the pressure of rinsing water supplied to the further inlet means urges the valve member to its second position. Suitably, the further inlet means is, when the valve member is in its second position, connected to the outlet means through the cylinder.

The present invention also includes an installation for dispensing liquid from a container, comprising a dispensing head as defined above, a source of pressurising gas connected to the first-mentioned inlet means, and a source of rinsing fluid connected to the further inlet means and to the inlet to the cylinder, a dispensing tap connected to the outlet means through a length of delivery pipe, and control means including a control valve for controlling the supply of rinsing fluid to the further inlet means and to the inlet to the cylinder.

The use of the pressure of the rinsing fluid to control the position of the valve member has the advantage that, when the dispensing head is fitted to an existing installation, there is no need to modify the existing conduit from the gas supply.

Figure 2:
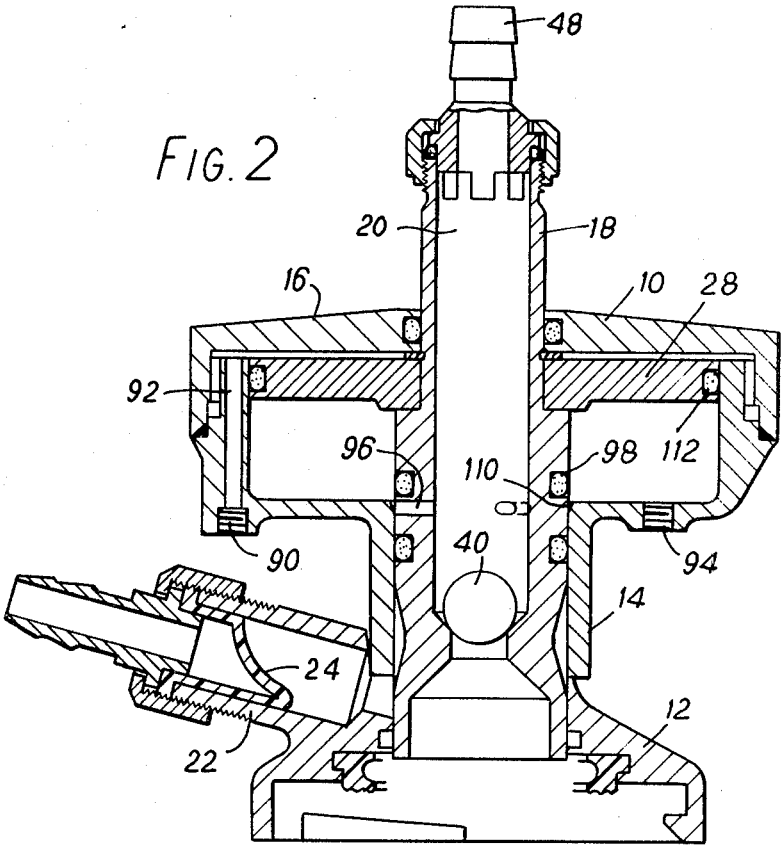

The invention will now be described, by way of example, with reference to the accompanying drawings, in which:

FIGS. 1 and 2 are vertical sections through a dispensing head in accordance with this invention, showing a valve member of the head in its lowermost and uppermost positions respectively.

Figure 4:
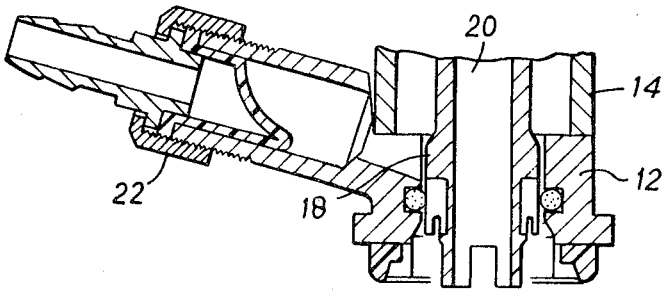
Figure 5:
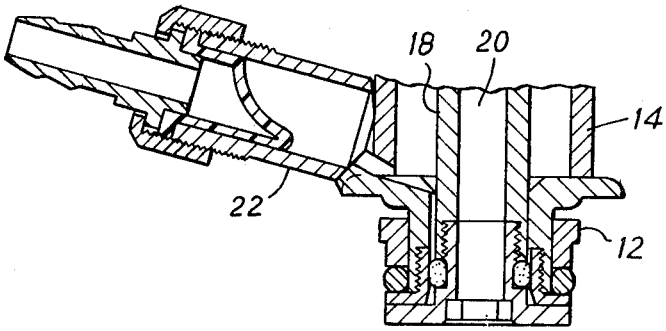
Figure 3:
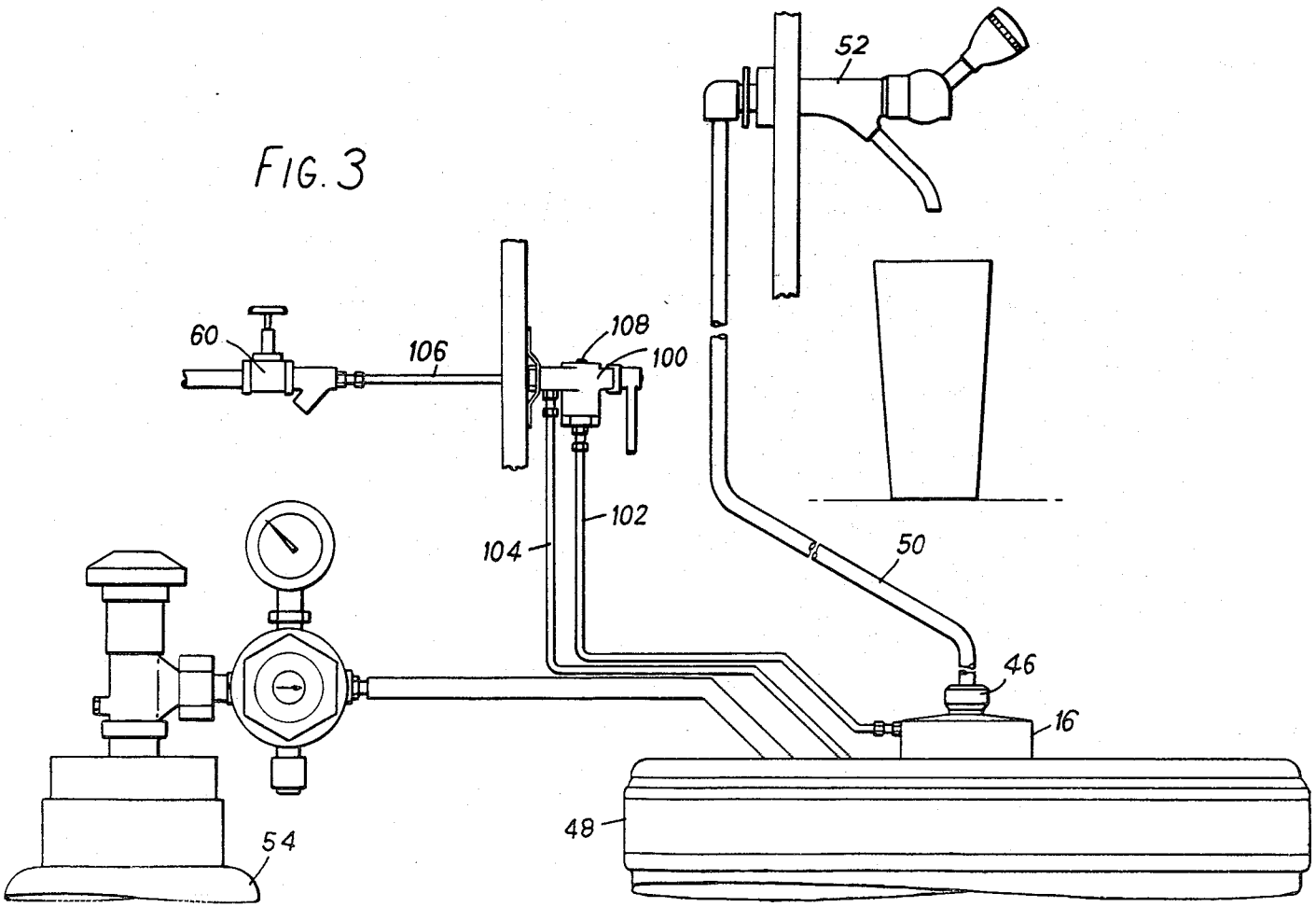
Figure 6:
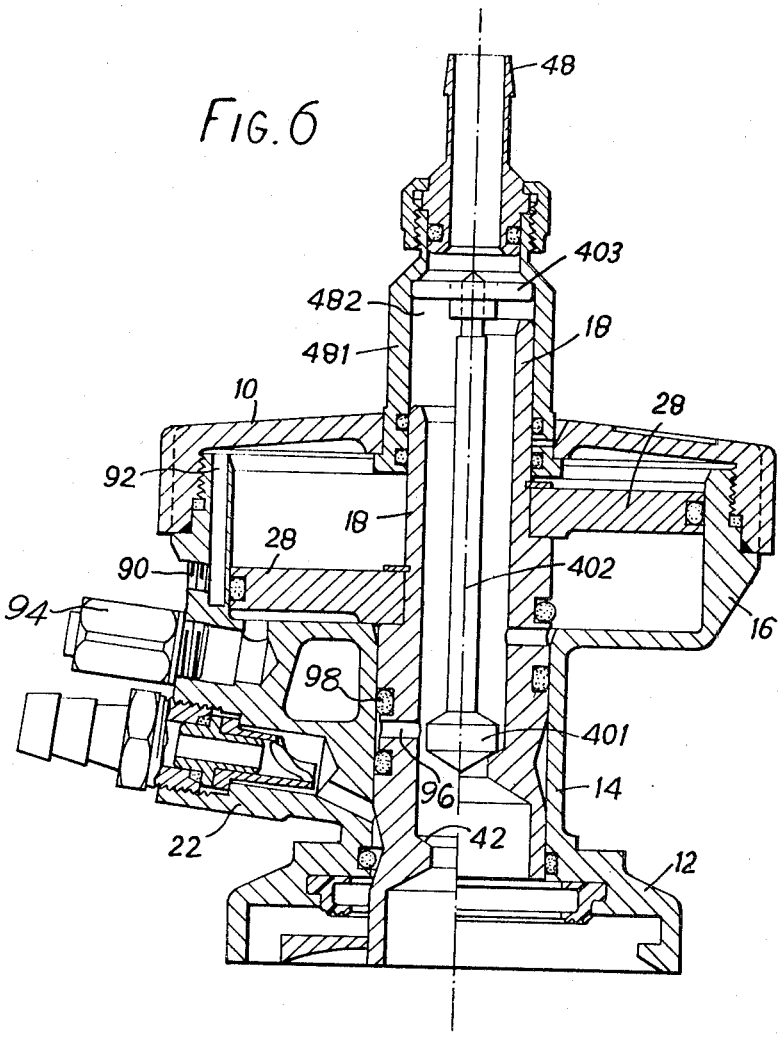

FIG. 3 shows an installation employing the dispensing head in accordance with this invention, FIGS. 4 and 5 are fragmentary vertical sections through the dispensing head modified to co-operate with two different keg tapping systems, and FIG. 6 shows a modification of the embodiment of FIGS. 1 and 2, the left-hand and right-hand halves of the Figure showing the valve member in its lowermost and uppermost positions respectively.

Referring to FIGS. 1 and 2, the dispensing head 10 comprises an adaptor 12 for connection to the tapping hole of a keg, a body 14 fixed to the adaptor and surmounted by a cylinder 16, and a valve member 18 vertically movable relative to the adaptor 12, body 14 and cylinder 16, the valve member having a longitudinally extending channel 20.

The adaptor 12 is shaped to fit onto the mouth of a keg, and the lower part of the valve member 18 is shaped to engage the valve plunger forming part of the keg, when the valve member is in its lowermost position, so that beer from the keg can flow through the channel 20 of the valve member. The various keg tapping systems in use, and the shape of the adaptor and lower part of the valve member necessary for use with each system, will be well known to those skilled in the art.

The adaptor 12 is formed in the usual way with a lateral inlet 22 to which can be connected a pipe supplying carbon dioxide gas under pressure, the gas entering the adaptor through a non-return valve 24. When the valve member 18 is in its lowermost position (as shown in FIG. 1) the inlet 22 is, in use, in communication with the interior of the keg, whilst when the valve member is in its uppermost position (as shown in FIG. 2) the inlet 22 is closed by engagement of the valve member with O-ring 26.

Fixed to the valve member 20 is a piston 28 which moves in the cylinder 16, engagement of the piston with the top and bottom internal faces of the cylinder defining the uppermost and lowermost positions of the valve member. The upper part of valve member 18 forms an outlet 48 to which can be connected a pipe 50 leading to a dispensing tap 52 (FIG. 3).

A control inlet 90, which as described below is to be connected to a source of rinsing water, is formed in the cylinder 16 and communicates through a channel 92 with the interior of the cylinder above the piston 28. A second rinsing inlet 94 opens into the cylinder 16 below the piston 28. When the valve member 18 is in its uppermost position as shown in FIG. 2 the interior of cylinder 16 below the piston is in communication with the central channel 20 of the valve member through a bore 96 in the valve member, so that rinsing water supplied to the inlet 94 can flow into the channel 20. When the valve member 18 is in its lowermost position as shown in FIG. 1 the bore 96 is closed and water is prevented from leaking into channel 20 by an O-ring 98. A one-way ball valve is provided in the channel 20, the ball 40 of the valve being moved against a valve seating 42 by the pressure of rinsing water when the valve member 18 is in its uppermost position, to prevent rinsing water entering the keg. When the valve member 18 is in its lowermost position the ball 40 can be lifted from its seating by pressure of liquid flowing from the keg.

FIG. 3 shows an installation employing the dispensing head of this invention. The dispensing head 10 is fitted to a keg 48, and the outlet 46 is connected through the pipe 50 to the dispensing tap 52, which is of conventional construction. The pipe 50, which preferably has a maximum interior diameter of 10 mm, may pass in the usual way through a chilling system. The inlet 22 of the adaptor 12 is connected through suitable piping to a cylinder 54 of compressed carbon dioxide. The inlets 90 and 94 to the cylinder 16 of the dispensing head 10 are connected through respective pipes 102 and 104 to a manually operated valve 100 which is located near to the dispensing tap 52 and which is connected through a pipe 106 and stopcock 60 to a source of rinsing water which may for example be mains water. (The inlets 90 and 94 are shown on the same side of the cylinder 16 in FIG. 3, for the sake of clarity). The connections to the various pipes are made through suitable unions in the usual way.

The manually operated valve 100 has two positions: a "dispensing" position in which the pipe 106 is connected to pipe 102, so that rinsing water is supplied to the control inlet 90, whilst the pipe 104 is connected to the vent 108, which is connected to a suitable drain, so that rinsing water inlet 94 is connected to the atmosphere, and a "rinsing" position in which pipe 106 is connected to pipe 104, so that rinsing water is supplied to the rinsing water inlet 94 whilst the supply of water to the control inlet 90 is cut off.

In operation of the installation shown in FIG. 3, before the dispensing head 10 is fitted to a full keg, the manually operated valve 100 is placed in the "rinsing" position. Water therefore enters inlet 94 and moves the valve member 18 to its uppermost position so that the water can enter the channel 20 through inlet 94, cylinder 16 and bore 96. The dispensing tap 52 is opened, and rinsing water flows through channel 20, pipe 50 and tap 52. The dispensing head is then fitted to the keg in the usual manner. The manually operated valve 100 is then moved to the "dispensing" position. Water is therefore supplied to inlet 90 and the pressure of water acting on piston 28 moves the valve member 18 to its lowermost position. The valve plunger incorporated in the keg is thus opened and gas is supplied through inlet 22 to the interior of the keg as described above so that beer flows through channel 20 and through pipe 50 to the dispensing tap 52. At the same time the supply of rinsing water to channel 20 through bore 96 is cut off. The bore 96 is so positioned that when the valve member 18 is in its uppermost position it opens into a chamfered recess 110 in the lower face of cylinder 16, so that the bore is closed as soon as the valve member begins to move towards its lowermost position, the remaining water in the cylinder 18 below piston 28 being exhausted through pipe 104 and vent 108 to the drain.

Since the rinsing water is thus automatically cut off as the plunger valve of the keg is opened, and since the volume between the bore 96 and the ball valve 40 is very small, the beer follows the water flowing in pipe 50 without interruption and with no danger of the water mixing with the beer or of an airlock forming in the pipe. Moreover, when the valve 100 is in the "dispensing" position and the valve member 18 is in its lowermost position there is no danger of leakage of water into the channel 20, since the only path through which water can get to bore 96 is through the lower part of cylinder 16 which is connected through inlet 94 to the vent 108 and thus at atmospheric pressure. The pressure in channel 20, which is provided by the pressurising gas from cylinder 54, is greater than that in the lower part of cylinder 16, so that even in the unlikely event of failure both of O-ring 98 and of O-ring 112 on piston 28 the water being supplied through inlet 90 could not enter bore 96 but would escape through inlet 94, so that the danger of contamination of the dispensed beer is eliminated.

With the valve 100 in the "dispensing position", the dispensing tap 52 is used to control the flow of beer from the keg in the usual manner.

When the keg is empty, and the dispensing head is to be connected to a new keg, the valve 100 is placed in the "rinsing" position, so that the supply of water to the upper part of cylinder 16 is cut off and water is supplied through inlet 94 to the lower part of the cylinder. The valve member 18 is consequently moved to its uppermost position under the pressure of water supplied through inlet 94 and the internal pressure of the keg, the water above piston 28 being exhausted through pipe 102 and vent 108. The valve member 18 is thus automatically detached from the valve plunger of the keg, and the supply of gas through inlet 22 in adaptor 12 is cut off. At the same time the bore 96 is placed in communication with cylinder 16 so that rinsing water flows through the dispensing head and the pipe 50. The dispensing head is then connected to the new keg, and the valve 100 is moved back to the "dispensing" position to cut off the rinsing water and connect the valve member 18 to the valve plunger of the new keg, as described above.

Since it is necessary to move the valve 100 to the "dispensing" position before the dispensing head is removed from the empty keg, the dispensing head cannot be moved from an empty keg to a full keg without rinsing water automatically flowing through the dispensing head and pipe 50. It is therefore ensured that the dispensing head and pipe are rinsed at least at every change of keg. Also, since the valve member is in its uppermost position the inlet 22 is closed by engagement of the valve member with the O-ring 26, so that there is no danger of leakage of carbon dioxide from the head as it is moved from the empty keg to the new one, and leakage of water is prevented by the valve 40.

In addition, the dispensing head can be operated to rinse the head and pipe 50 and to disconnect the valve member 18 from the keg whenever there is a prolonged interruption in delivery from the keg, overnight for example. To do this, the valve 100 is placed in the "rinsing" position and the dispensing tap 52 is opened until water flows from the dispensing tap. The dispensing tap 52 is then closed, and the valve 100 is left in the "rinsing" position. The valve member 18 is then disconnected from the valve plunger and water remains in the dispensing head and pipe 50 until the valve 100 is again placed in the "dispensing" position when delivery of beer is to be recommenced. It will be apparent that the operations just described can be carried out from a position near the dispensing tap, without the operator having to go to the cellar or room housing the kegs and carbon dioxide cylinder and associated equipment.

As mentioned above, the adaptor 12 of the dispensing head can be modified to suit any of the various keg tapping systems in use. For example, FIGS. 4 and 5 illustrate the modified form of the adaptor for two such tapping systems.

In the installation described, the ease with which the dispensing head and the pipe leading to the dispensing tap can be rinsed, and the automatic rinsing at each change of keg, means that the periodic cleaning of the installation can be reduced considerably, or eliminated completely.

FIG. 6 shows a modification of the embodiment of FIGS. 1 and 2, in which the valve member 18 is shortened, its length being sufficient to extend through the cylinder 16 when in its lowermost position (as shown on the left-hand side of FIG. 6). The outlet 48 is formed on a neck 481 which is fixed to the cylinder 16 and has a cylindrical cavity 482 long enough to receive the valve member 18 in its uppermost position (as shown on the right-hand side of FIG. 6). Instead of a ball valve 40, this embodiment is provided with a non-return valve member 401 secured to the lower end of a vertical stem 402 which is fixed at its upper end to the neck 481 by a member 403 suitably perforated so as not to obstruct the flow of liquid to the outlet 48. The non-return valve member 401 is positioned so as to engage the valve seat 42 on the valve member 18 when the latter is in its uppermost position, to prevent rinsing water entering the keg. There is thus a positive shut-off of communication between the interior of valve member 18 and the keg when the pressure of rinsing water moves the valve member to its uppermost position. The dispensing head is provided with separate rinsing water inlets 90 and 94 as in the previously described embodiments, the inlets 90 and 94 in FIG. 6 being shown on the same side of the dispensing head.

It will be appreciated that various modifications could be made to the dispensing head and installation of the described embodiments. For example, the manually operated valve could be replaced with a solenoid-operated valve positioned in the cellar and controlled by an electric switch positioned near the dispensing tap. Instead of water, a supply under pressure of gas or of any other suitable liquid could be used.

We claim:

1. A dispensing head adapted to be fitted to a container having a valve plunger with which the dispensing head co-operates to enable liquid in the container to be dispensed through the dispensing head under pressure of a gas supplied to the container through the dispensing head, the dispensing head comprising:

a. a body;

b. gas inlet means in said body for connection to a source of the pressurising gas;

c. rinsing fluid inlet means in said body for connection to a source of rinsing fluid;

d. outlet means for connection to a dispensing tap;

e. a valve member vertically movable in said body between a first position in which:

(i) the valve member engages the valve plunger and holds it in its open position, (ii) the gas inlet means is in communication with the interior of the container to which the dispensing head is fitted and the outlet means is in communication with the interior of the container through the valve plunger so that liquid is dispensed from the container, and (iii) communication between the rinsing fluid inlet means and the outlet means is cut off, and a second position in which:

(i) the valve member is disengaged from the valve plunger, and (ii) the outlet means is disconnected from the interior of the container and placed in communication with the rinsing fluid inlet means so that rinsing dluid flows through the outlet means;

f. a piston fixed to said valve member and movable in a cylinder forming part of said body;

g. control inlet means for connection to the source of rinsing fluid, said control inlet means opening into said cylinder so that when rinsing fluid is supplied to the control inlet means the pressure of the rinsing fluid acts on the piston to urge the valve member to said first position.

2. A dispensing head as claimed in claim 1, wherein the rinsing fluid inlet means is in communication with the cylinder so that when rinsing water is supplied to the rinsing fluid inlet means whilst supply of rinsing water to the control inlet means in the cylinder is cut off, the pressure of rinsing water supplied to the rinsing fluid inlet means urges the valve member to its second position.

3. A dispensing head as claimed in claim 2, wherein the rinsing fluid inlet means is, when the valve member is in its second position, connected to the outlet means through the cylinder.

4. An installation as claimed in claim 1, wherein the rinsing fluid is mains water.

5. An installation as claimed in claim 1, and adapted for dispensing beer or lager from a keg, in which the pressurising gas is carbon dioxide.

6. A dispensing head as claimed in claim 1, wherein the rinsing fluid inlet means includes a second inlet opening into the cylinder on the side of the piston remote from the control inlet means, and passage means in the valve member which, when the valve member is in the second position, effect communication between the outlet means and the cylinder on the said side of the piston.

7. A dispensing head as claimed in claim 6, wherein the valve member has a longitudinal internal channel forming said outlet means, and said passage means comprises a radial passage extending from said channel to the outside of the valve member, the passage opening into the cylinder when the valve member is in the second position and being closed by an adjacent internal face of said body when the valve member is in the first position.

8. An installation for dispensing liquid from a container, comprising a source of pressurising gas, a source of rinsing fluid, a dispensing tap, a control valve and a dispensing head adapted to be fitted to the container, the container having a valve plunger with which the dispensing head co-operates to enable liquid in the container to be dispensed through the dispensing head under pressure of a gas supplied to the container through the dispensing head, wherein dispensing head comprises:

a. a body;

b. gas inlet means in said body connected to said source of the pressurising gas;

c. a rinsing fluid inlet in said body connected to said source of rinsing fluid;

d. outlet means connected to said dispensing tap through a length of delivery pipe;

e. a valve member vertically movable in said body between a first position in which:

(i) the valve member engages the valve plunger and holds it in its open position, (ii) the gas inlet means is in communication with the interior of the container to which the dispensing head is fitted and the outlet means is in communication with the interior of the container through the valve plunger so that liquid is dispensed from the container, and (iii) communication between said rinsing fluid inlet and the outlet means is cut off, and a second position in which:

(i) the valve member is disengaged from the valve plunger, and (ii) the outlet means is disconnected from the interior of the container and placed in communication with said rinsing fluid inlet so that rinsing fluid flows through said outlet means, said delivery pipe and said dispensing tap;

f. a piston fixed to said valve member and movable in a cylinder forming part of said body;

g. a control inlet in said body connected to said source of rinsing fluid through said control valve, said control inlet opening into said cylinder so that when said control valve is operated to supply rinsing fluid to the control inlet the pressure of the rinsing fluid acts on the piston to urge the valve member to said first position.

9. An installation as claimed in claim 8, wherein the source of rinsing fluid is connected to the rinsing fluid inlet through the said control valve, the control valve having a first position in which fluid is supplied to the control inlet whilst the fluid supply to the rinsing fluid inlet is cut off and a second position in which fluid is supplied to the rinsing fluid inlet whilst the fluid supply to the control inlet is cut off.

10. An installation as claimed in claim 9, wherein the rinsing fluid inlet opens into the cylinder on the side of the piston remote from the control inlet, the part of the cylinder on the said side of the piston being in communication with the outlet means when the valve member is in its second position.

11. An installation as claimed in claim 10, wherein the control valve has a vent outlet which is connected to a drain, the rinsing fluid inlet being in communication with the vent outlet when the valve member is in its first position so that the part of the cylinder on the said side of the piston is relieved of pressure.

* * * * *